US008782958B2

(12) United States Patent
Rivera, Jr. et al.

(10) Patent No.: US 8,782,958 B2
(45) **Date of Patent: *Jul. 22, 2014**

(54) MOBILE FOLDING CHORAL RISER WITH HIGH-SPEED CYLINDER LIFT-ASSIST MECHANISM AND PARTIALLY INDEPENDENT BACK RAILING LINKAGE

(71) Applicant: AmTab Manufacturing Corporation, Aurora, IL (US)

(72) Inventors: Jeremias C. Rivera, Jr., Elmhurst, IL (US); Doss Samikkannu, Des Plaines, IL (US); Gregory Hanusiak, Chicago, IL (US); Zelio Ferrarini, Oswego, IL (US)

(73) Assignee: AmTab Manufacturing Corporation, Aurora, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/856,319

(22) Filed: Apr. 3, 2013

(65) Prior Publication Data

US 2013/0255163 A1 Oct. 3, 2013

Related U.S. Application Data

(63) Continuation of application No. 12/927,570, filed on Nov. 18, 2010, now Pat. No. 8,413,384.

(51) Int. Cl.
*E04H 3/28* (2006.01)

(52) U.S. Cl.
USPC ..... 52/7; 52/10; 108/169

(58) Field of Classification Search
USPC ..... 52/7–10; 108/169
See application file for complete search history.

(56) References Cited

U.S. PATENT DOCUMENTS

| | | | | | |
|---|---|---|---|---|---|
| RE19,373 | E | * | 11/1934 | Wetzel | 52/10 |
| 2,030,776 | A | * | 2/1936 | Vance | 52/10 |
| 3,101,062 | A | * | 8/1963 | Kanzelberger | 108/37 |
| 3,747,706 | A | * | 7/1973 | Paine et al. | 182/113 |
| 3,974,894 | A | | 8/1976 | Wenger et al. | |
| 4,596,196 | A | | 6/1986 | Gunter et al. | |
| 4,930,277 | A | | 6/1990 | Krumholz et al. | |
| 4,979,340 | A | * | 12/1990 | Wilson et al. | 52/9 |
| 5,080,024 | A | | 1/1992 | Yamamoto | |
| 5,357,876 | A | | 10/1994 | Kniefel et al. | |
| 5,381,873 | A | * | 1/1995 | Kniefel et al. | 182/152 |
| 5,758,784 | A | | 6/1998 | Chambers | |
| 5,787,647 | A | | 8/1998 | Dettmann et al. | |
| 5,901,505 | A | * | 5/1999 | Dettmann et al. | 52/6 |
| 8,205,937 | B2 | | 6/2012 | Rivera et al. | |
| 8,413,384 | B2 | | 4/2013 | Rivera et al. | |
| 2010/0301641 | A1 | * | 12/2010 | Rivera et al. | 297/158.4 |

* cited by examiner

*Primary Examiner* — Adriana Figueroa
(74) *Attorney, Agent, or Firm* — Hinshaw & Culbertson LLP

(57) ABSTRACT

The present invention provides a mobile folding choral riser having lift-assist and stability mechanisms. In particular, the choral riser includes a gas cylinder that provides a force tending to extend the cylinder to assist in folding the riser into a storage position, the cylinder providing substantially no force to resist rapid extension thereof. In addition, the choral riser preferably includes a back railing linkage that permits independent raising and lowering of a back railing member when the choral riser is in a use or partially folded position but constrains the back railing member to a raised position when the choral riser is in an at least substantially fully folded position.

4 Claims, 5 Drawing Sheets

MOBILE FOLDING CHORAL RISER WITH HIGH-SPEED CYLINDER LIFT-ASSIST MECHANISM AND PARTIALLY INDEPENDENT BACK RAILING LINKAGE

CROSS REFERENCE TO RELATED APPLICATION

This application is a continuation of U.S. patent application Ser. No. 12/927,570, filed Nov. 18, 2010, having a projected issue date of Apr. 9, 2013 and projected U.S. Pat. No. 8,413,384.

FIELD OF THE INVENTION

The present invention relates to mobile folding choral risers. More particularly, it relates to mobile folding choral risers having lift-assist mechanisms and a back railing member, the back railing member including feet that contact the floor in a use position and a safety railing structure configured to prevent performers standing on a top deck from falling backward.

BACKGROUND OF THE INVENTION

Mobile folding choral risers are useful for enabling choral groups to travel to and perform at locations that lack a permanent tiered structure. Typically, they include a plurality of tiered decks that move to and from a horizontal orientation corresponding to an unfolded, use position of the riser and a vertical orientation corresponding to a folded, storage position of the riser. For strength and stability purposes, existing mobile folding choral risers typically have heavy decks and a heavy folding frame, and are therefore difficult to lift from an unfolded, use position to a folded, moving and storage position.

In addition, a mobile folding choral riser typically includes a plurality of stabilizing feet, the feet configured to contact the floor to resist undesired movement of the riser when the riser is in the unfolded, use position and to lift off of the floor to permit free movement of the choral riser on casters when the riser is in the folded, moving and storage position. The feet are typically attached to folding portions of the riser proximate to at least the outermost corners of the riser. For example, feet may be attached to the front corners of a folding deck linkage, and to a folding back railing linkage. In existing choral risers, the back railing linkage is operatively connected to the folding deck linkage so that a back railing member is constrained to be raised towards the folded position whenever the decks are being folded and to be lowered towards the unfolded position whenever the decks are being unfolded. In this manner, the feet connected to the back railing member are configured to automatically lift off the floor to facilitate movement of the riser when the riser is partially or fully folded, and to automatically contact the floor to facilitate stability of the riser when the riser is fully unfolded. However, this arrangement has disadvantages, as a partially folded riser will tend to be pushed backward on its casters when a single user is attempting to fold the riser by lifting from the front (bottom) deck.

A need therefore exists for a mobile folding choral riser that is safe, stable, and easy to fold to and from a use position and a storage position.

BRIEF SUMMARY OF THE INVENTION

In accordance with one aspect of the present invention, a mobile folding choral riser is provided, comprising a base frame; a plurality of casters mounted to a bottom side of the base frame and configured to support the choral riser during movement and storage of the choral riser; a folding deck linkage connected to a front side of the base frame; and a plurality of tiered decks attached to the folding deck linkage. The decks are configured to move to and from an at least substantially horizontal orientation corresponding to an unfolded use position of the folding deck linkage and a generally vertical orientation corresponding to a folded moving and storage position of the folding deck linkage. At least one deck foot, and typically two or four deck feet, are attached to the folding deck linkage and configured to contact a floor surface when the deck linkage is unfolded for use. In this manner, the deck foot bears at least a portion of the weight of and supported by the decks and frictionally restrains movement of the choral riser across the floor surface when the folding deck linkage is in the unfolded position. For example, each deck foot may be directly attached to a lowest deck, and the deck linkage may constrain the decks to pivot together relative to the base frame, so that a generally downward load may be transmitted from higher decks to the lowest deck through the deck linkage, and from the lowest deck directly to the foot. To facilitate moving the riser in the folded position across the floor surface on its casters, each deck foot is configured to lift off of the floor surface when the folding deck linkage is moved from the unfolded position toward the folded position and to remain off of the floor surface when the folding deck linkage is in a partially folded position or the folded position.

In addition, a back railing linkage is connected to a rear side of the base frame. The back railing linkage includes a back railing member, the back railing member having at least one attached back railing foot. The back railing linkage is configured for raising and lowering movement of the back railing member relative to the base frame. In particular, the back railing member is movable to and from a lowered use position, in which the back railing foot contacts a floor surface when the choral riser is supported on the floor surface to bear at least a portion of the weight of the back railing member and to restrain movement of the choral riser across the floor surface, and a raised moving and storage position, in which the back railing foot is lifted off of the floor surface. To promote performer safety, the back railing member includes a rear obstruction extending above a rearmost one of the plurality of decks, the rear obstruction configured to at least substantially prevent a person standing on the rearmost deck from falling backwards off of the rearmost deck. The back railing member may be configured to prevent such falling regardless of its relatively raised or lowered position.

To facilitate automatic lifting of the back railing foot off of the floor surface when the folding deck linkage is in its folded position, the folding deck linkage includes an engagement member adapted to contact an actuation member of the back railing linkage. This engagement contact occurs when the back railing member is in its lowered position and the folding deck linkage is at an engagement position, the engagement position of the folding deck linkage located between the folded and unfolded positions of the folding deck linkage. The engagement member is adapted to apply a force to the actuation member as the folding deck linkage is then moved from the engagement position to the folded position, to cause the back railing member to move from the lowered position to the raised position. However, the back railing member is freely movable to and from its raised and lowered positions when the folding deck linkage is at either of or between its unfolded and engagement positions, i.e., whenever the engagement member does not obstruct the movement of the actuation member to a position corresponding to the lowered position of the back railing member.

Preferably, the engagement position is located so that the back railing feet are permitted to remain in contact with the floor through most of the folding motion of the deck linkage from the unfolded position toward the folded position, thus providing stability and restraining undesired rolling of the riser across the floor surface. For example, in one embodiment, the foremost deck is inclined at least about 60 degrees from the floor when the folding deck linkage is in the engagement position. Still more preferably, the foremost deck may be inclined about 85 degrees from the floor when the folding deck linkage is in the engagement position. In this manner, the back railing foot remains on the floor until a point at which a human user lifting the foremost deck is close enough to the back side of the riser to manually restrain undesired backward rolling during the last portion of the folding action. Preferably, the foremost deck, and still more preferably all of the decks (e.g., by the deck linkage constraining the decks to remain at least generally parallel), is/are folded at least about 90 degrees from the floor when the folding deck linkage is in the folded position. It may be advantageous for the decks to be folded slightly more than 90 degrees from the floor to produce a stable "over-center" condition in which the weight of the decks tends to slightly urge the deck linkage toward, rather than away from, the folded position.

In another embodiment, the riser further comprises a lift-assist cylinder assembly. The cylinder assembly includes a first member and a second member slidably connected to the first member for movement of the members between fully contracted and fully extended positions, the first member having a first end connected to the base frame and the second member having a second end connected to the folding deck linkage. Compressed fluid in the cylinder assembly is adapted to produce a force tending to move its members apart from each other to extend the assembly toward the fully extended position, and the cylinder assembly is mounted so that extending the cylinder assembly toward the fully extended position causes the decks to fold, generally upwardly and rearwardly, toward the folded position. In this manner, the cylinder assembly provides a lift-assisting force to help a human user fold the riser. Conversely, unfolding the decks causes the cylinder assembly to contract toward the fully contracted position. As the cylinder assembly produces a force to resist this contraction, the cylinder assembly also helps a human user unfold the riser at a controlled speed.

In another aspect of the invention, a lift-assisted mobile folding choral riser comprises a base frame, a plurality of casters mounted to movably support the base frame on a floor surface, and a folding deck linkage connected to a front side of the base frame, substantially as in the previously described aspect. Similarly to one embodiment described above, a high-speed cylinder assembly is provided to assist a human user in low-effort folding and restrained unfolding of the folding deck linkage. The high-speed cylinder assembly includes a first member and a second member slidably connected to the first member for movement of the members between fully contracted and fully extended positions, the first member having a first end connected to the base frame and the second member having a second end connected to the folding deck linkage. The cylinder assembly contains compressed fluid adapted to produce a force tending to move its members apart from each other to extend the assembly toward the fully extended position. Also as described above, the cylinder assembly is configured to cause the decks to fold, generally upwardly and rearwardly, toward the folded position when the cylinder assembly is extended toward the fully extended position, and conversely, to be caused to contract when the decks are unfolded toward the unfolded position. The additional feature of this aspect of the invention, which makes the cylinder assembly a high-speed cylinder assembly, is that unlike typical existing gas cylinder assemblies for providing a lift-assisting force to a human user, the high-speed cylinder assembly produces substantially no force to oppose rapid extension of the assembly.

The mobile folding choral riser may also include a back railing linkage substantially as described above, but a back railing linkage is not required according to this aspect of the invention. For example, a back railing member fixedly attached to the base frame may suffice for safety purposes, although the advantage of liftable back railing feet providing frictional stability to resist undesired rolling of the riser during the folding process would be lost.

DETAILED DESCRIPTION OF THE INVENTION

A mobile folding choral riser that is stable, safe, easy to move, and easy to fold and unfold between a folded moving and storage position and an unfolded use position is described in this section.

Figure 1:
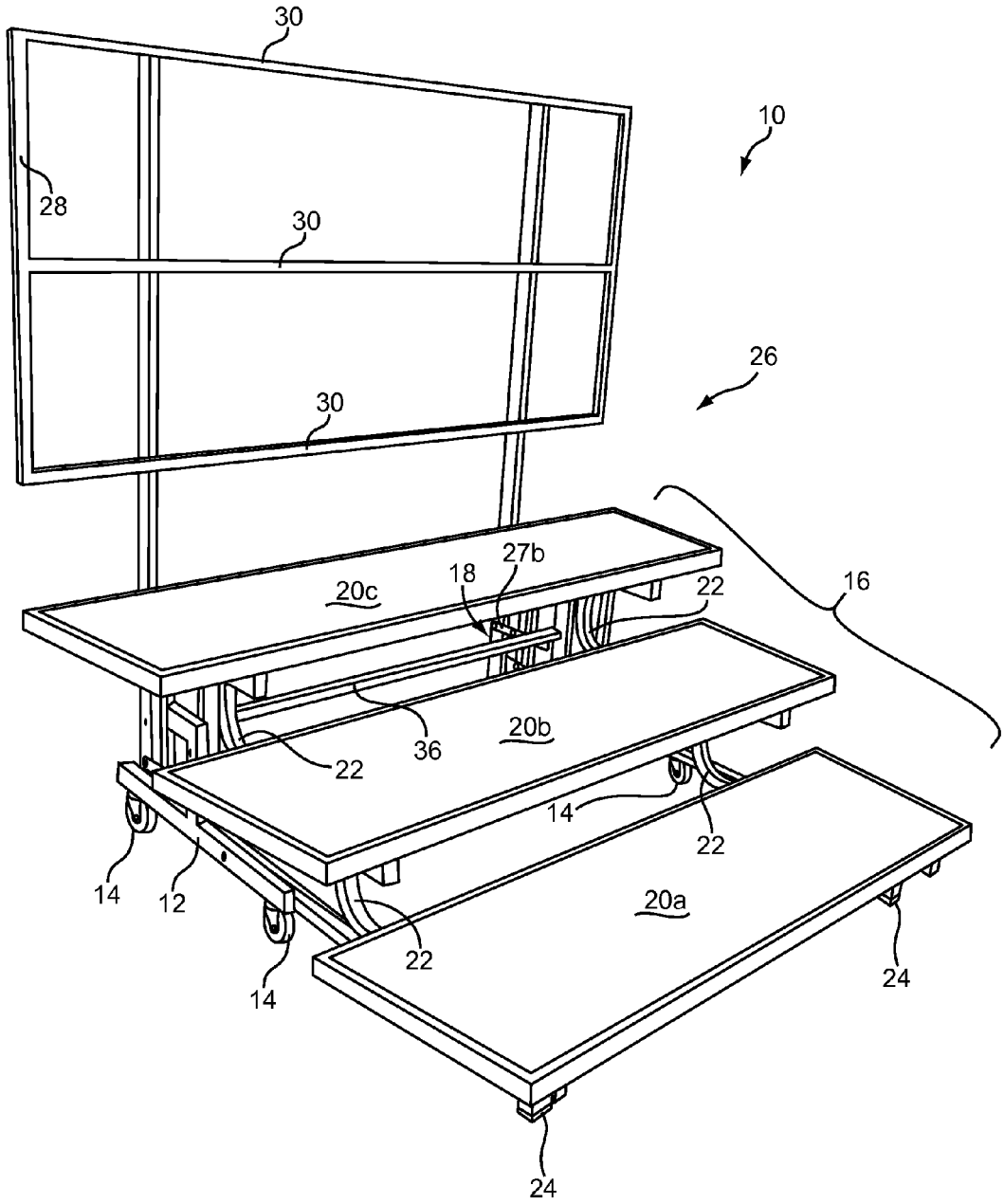
FIG. 1 is a perspective view of a choral riser according to the invention, shown in an unfolded use position.
Figure 2:
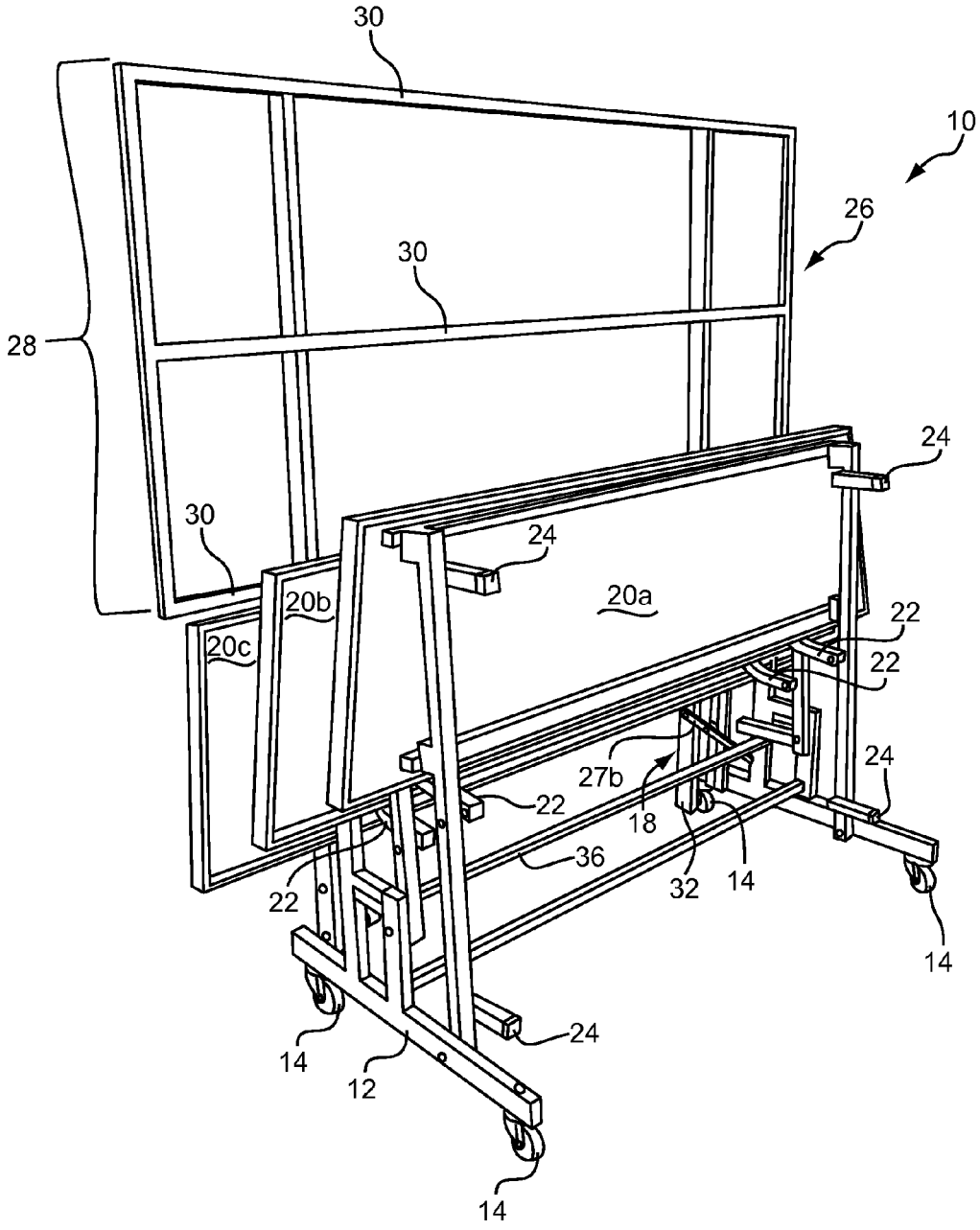
FIG. 2 is a perspective view of a choral riser according to the invention, shown in a folded moving and storage position.
Figure 3:
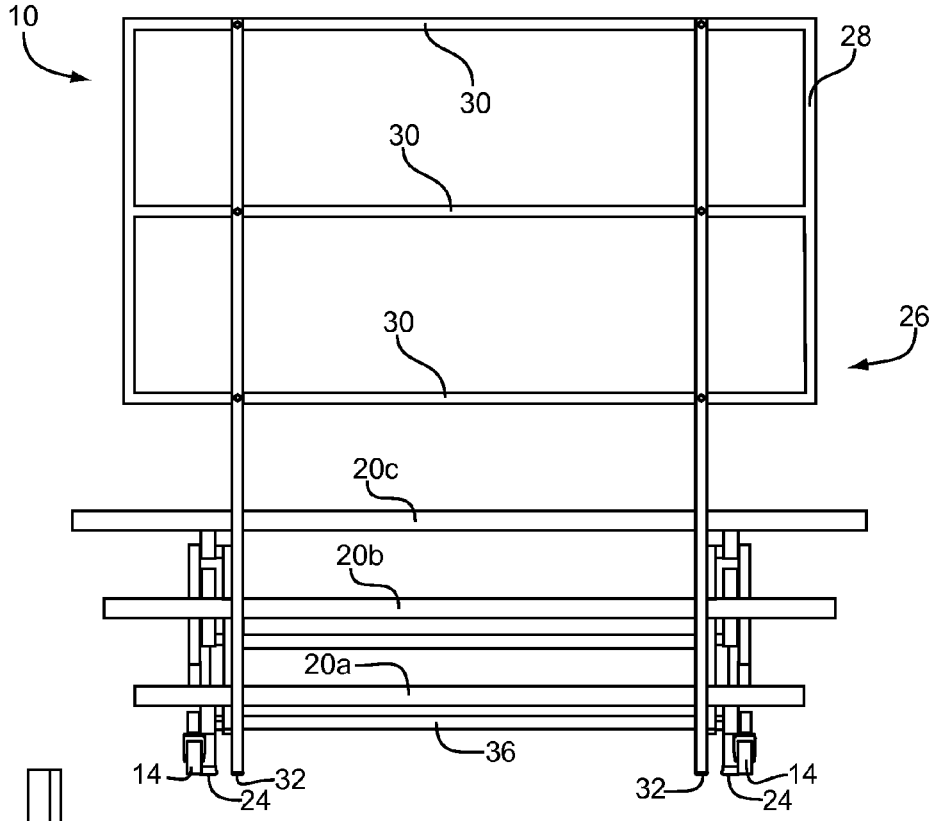
FIG. 3 is a rear elevation view of a choral riser according to the invention, showing a back railing member of the choral riser in full view.

With reference to FIG. 1, a choral riser 10 according to the invention is shown in perspective view in the unfolded use position. Choral riser 10 includes a base frame 12 supported by casters 14, a deck linkage 16, and a back railing linkage 18. Deck linkage 16 includes a lower deck 20*a*, a middle deck 20*b*, and an upper deck 20*c* that are pivotally connected to base frame 12 and constrained to pivot together by deck connector links 22. When riser 10 is in the folded moving and storage position shown in perspective view in FIG. 2, the entire weight of riser 10 is supported and transmitted to the floor by casters 14. However, lower deck 20*a* includes attached deck feet 24, which are configured to contact the floor and to transmit to the floor at least a portion of forces associated with the weights of and borne by decks 20*a*-20*c* when riser 10 is in the unfolded use position. Back railing linkage 18 includes a back railing member 26 connected to base frame 12 by back railing connector links 27*a*, 27*b*, and 27*c* for raising and lowering of back railing member 26 relative to base frame 12 to and from a lowered use position and a raised moving and storage position. Back railing member 26 comprises a safety railing structure 28 including a plurality of safety railings 30. Safety railing structure 28 is configured to at least substantially prevent a performer standing on upper deck 20*c* from inadvertently falling backward off of upper deck 20*c*. Safety railing structure 28 is shown as including three generally horizontal safety railings 30 extending across substantially the entire width of upper deck 20*c* to accommodate performers within a typical range of heights. However, it should be noted that, within the scope of the invention, more safety railings could be added, or one or more of horizontal safety railings 30 could be omitted and replaced by any suitable structure configured to obstruct performers within a typical range sizes and heights from falling backward off of upper deck 20*c*, including but not limited to vertical safety railings, high-tension cables, or a substantially continuous panel or lattice (not shown). Back railing member 26 also includes back feet 32, best seen in FIG. 3 configured to contact the floor in the lowered position of back railing member 26 to bear at least a portion of the weight of back railing member 26 and to help to stabilize choral riser 10 by providing friction forces to restrain lateral movement of choral riser 10.

Figure 4:
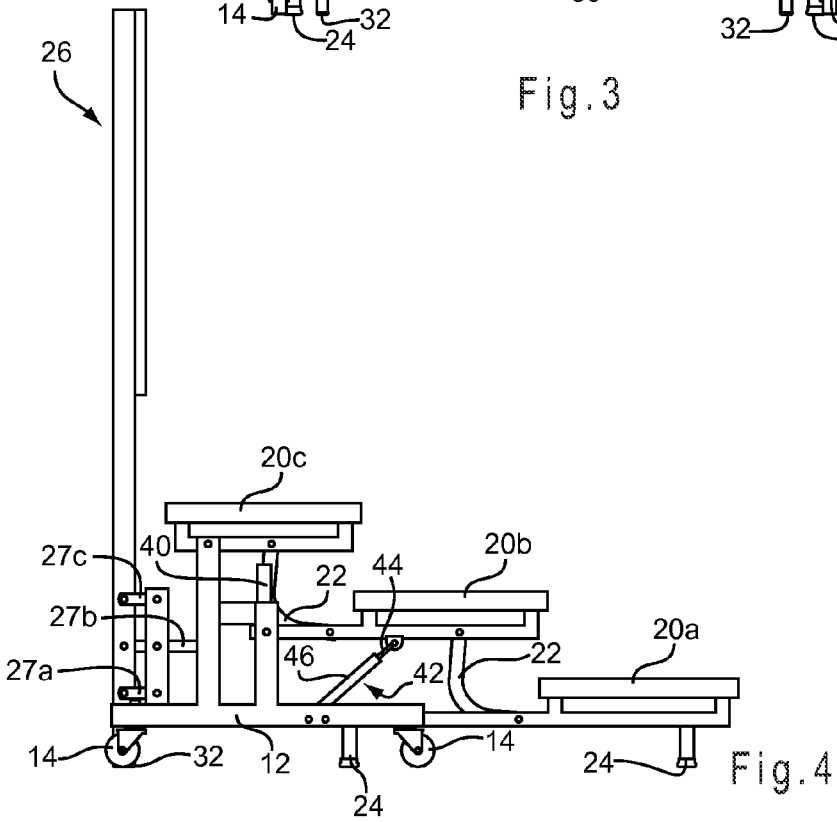
FIG. 4 is a full side elevation view of a choral riser according to the invention, shown in the unfolded use position with a contracted gas cylinder assembly.
Figure 5:
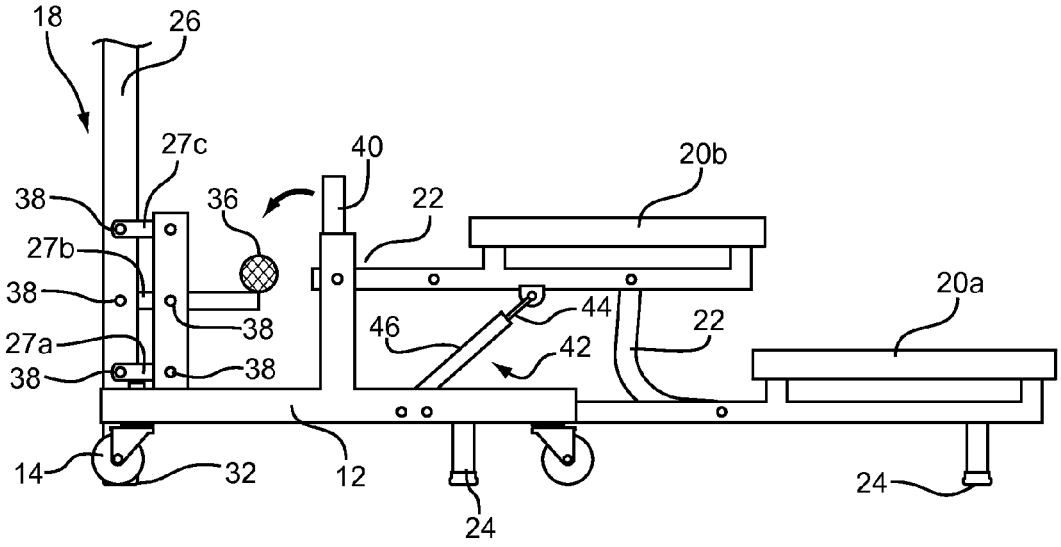
FIG. 5 is a fragmentary side elevation view of some components of a choral riser according to the invention, shown in the unfolded use position.
Figure 6:
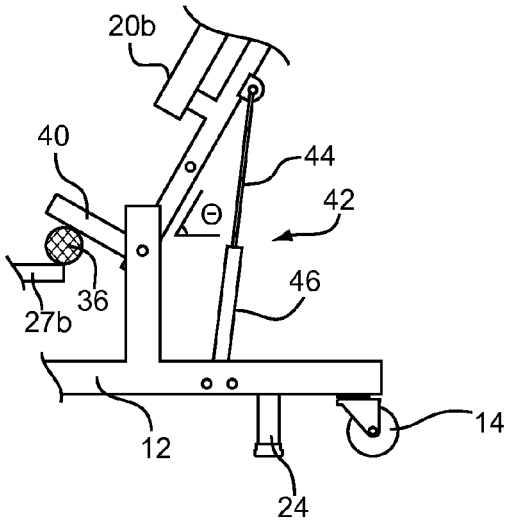
FIG. 6 is a fragmentary side elevation view of some components of a choral riser according to the invention, shown in the engagement position of an engagement member and actuator bar.
Figure 7:
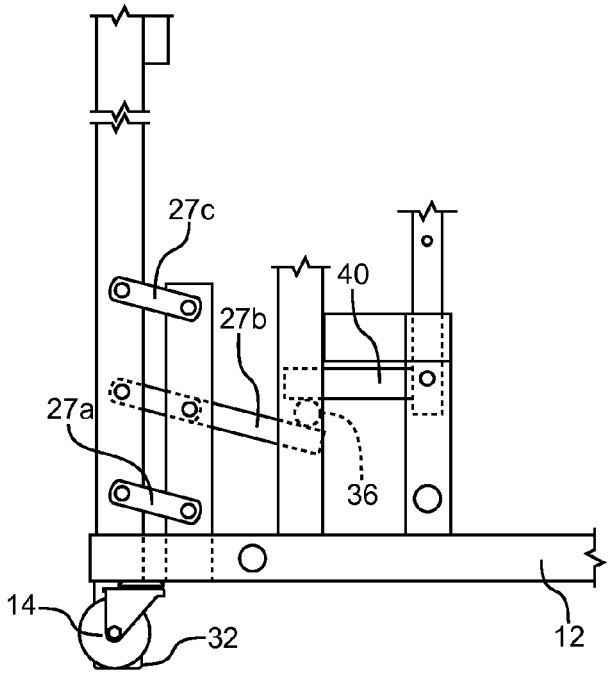
FIG. 7 is a fragmentary side elevation view of some components of a choral riser according to the invention, shown in the folded moving and storage position.

As mentioned above, back railing member 26 is connected to base frame 12 by back railing connector links 27*a*-27*c* to form back railing linkage 18. Advantageously, back railing linkage 18 is partially independent of deck linkage 16. That is, deck linkage 16 lacks any positive restraining mechanism to prevent back railing member 26 from being lifted to the raised position, regardless of the position of deck linkage 16. However, deck linkage 16 does include a mechanism that forces back railing member 26 to be lifted from the lowered position toward the raised position as deck linkage 16 is moved from a particular partially folded position referred to herein as the "engagement position" to the fully folded position. With reference to FIG. 4, a side elevation view of riser 10, and FIGS. 5-7, depicting the side view of riser 10 shown in FIG. 4 with some elements removed for illustrative purposes, an actuator bar 36 is connected to back railing connector links 27*b* at a location on links 27*b* frontward of pivot points 38, so that downward motion of actuator bar 36 causes upward motion of back railing member 26. FIGS. 5 and 7 depict the unfolded and folded positions of riser 10, respectively, and FIG. 6 depicts the engagement position.

At the engagement position of deck linkage 16, an engagement member 40 integrally attached to deck 20*b* contacts the top surface of actuator bar 36, and on further movement of deck linkage 16 towards the folded position, engagement member 40 begins to move downwardly against actuator bar 36 to cause back railing member 26 to be lifted toward the raised position. Thus, when deck linkage 16 is folded past the engagement position, back railing member 26 is prevented from moving to the lowered position. When deck linkage 16 is fully folded, it is of no particular importance that back railing member 26 be in its highest raised position permitted by back railing linkage 18, but only that back feet 32 be lifted off of the floor, so that riser 10 may be freely moved laterally across the floor surface on casters 14. Although engagement member 40 is depicted in the illustrated embodiment as integrally attached to deck 20*b*, it is within the scope of the invention for an engagement member to be attached to any suitable part of a deck linkage, so as to engage an actuator member of a back railing linkage at a partially folded engagement position of the deck linkage and to press against the actuator member to raise a back railing member off of a floor surface as the deck linkage is folded from the engagement position to a fully folded position.

To facilitate stable folding of deck linkage 16, the present inventors have found that it is advantageous to configure the position and range of motion of engagement member 40 so that the engagement position is close to the fully folded position of deck linkage 16. In this manner, back feet 32 are permitted to remain on the floor through most of the folding process, helping to restrain undesirable backward movement of riser 10 on casters 14 when a single person is lifting at the front of lower deck 20*a* to fold deck linkage 16. For example, it is advantageous for the angle of inclination θ of decks 20*a*-20*c* from the floor surface, as shown in FIG. 6, to be at least about 60°, and preferably about 85°, when deck linkage 16 is in the engagement position.

A lift-assisting mechanism of choral riser 10 will now be described with reference to FIGS. 4 and 8. In particular, choral riser 10 includes gas cylinder assemblies 42 having a piston member 44 mounted slidably within a cylinder member 46 to permit contraction and extension of each gas cylinder assembly 42 by the movement of piston member 44 into and out of cylinder member 46, respectively. Gas cylinder assemblies 42 as described and illustrated herein are configured so that compressed gas in cylinder members 46 provides a spring force tending to extend assemblies 42; however, one skilled in the art will understand that gas cylinder assemblies configured to provide a spring force tending to contract the assembly are also within the scope of the invention and could be advantageously used in certain configurations in certain types of linkages. In general, gas cylinder assemblies according to the present invention may be advantageously employed in any suitable position in a folding choral riser linkage so as to provide a force to assist in the folding and controlled unfolding of a choral riser.

Figure 8:
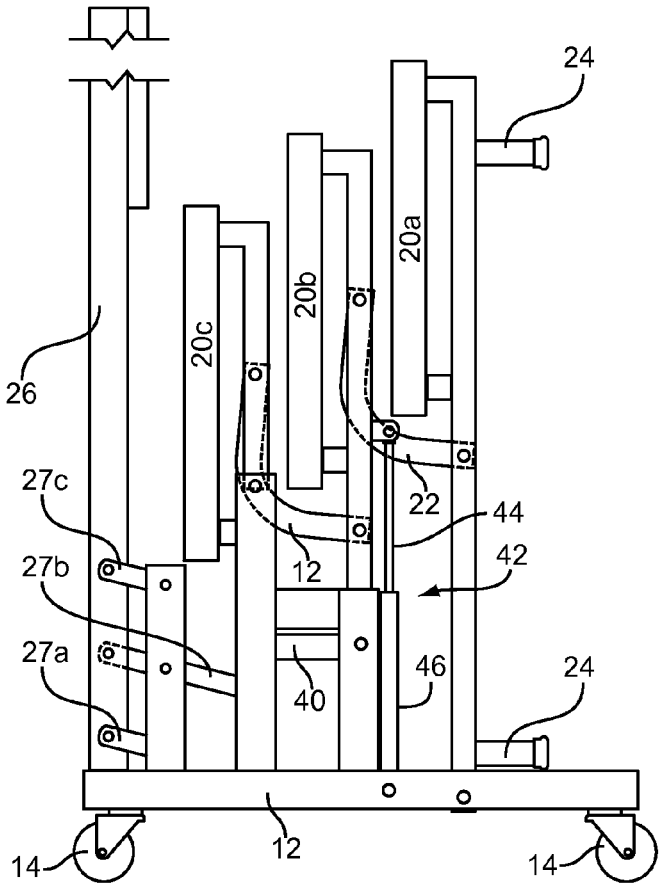
FIG. 8 is a full side elevation view of a choral riser according to the invention, shown in the folded moving and storage position with an extended gas cylinder assembly.

Turning to FIGS. 4 and 8, cylinder members 46 are pivotally connected to base frame 12 and piston members 44 are pivotally connected to deck linkage 16. As seen in FIG. 4, gas cylinder assemblies 42 are in a relatively contracted position when deck linkage 16 is in the unfolded position, and as seen in FIG. 8, gas cylinder assemblies are in a relatively extended position when deck linkage 16 is in the folded position. It can thus be seen that the extension of gas cylinder assemblies 42 causes deck linkage 16 to move toward the folded position, and inversely, movement of deck linkage 16 toward the unfolded position causes the contraction of gas cylinder assemblies 42. Therefore, since gas cylinder assemblies 42 are provided with a spring force tending to extend and to oppose contraction of assemblies 42, assemblies 42 reduce the human effort required to fold deck linkage 16 and also that required to unfold deck linkage 16 at a controlled speed.

Preferably, gas cylinder assemblies 42 are of a type that may be conveniently termed "high-speed cylinder" assemblies. High-speed cylinder assemblies are best understood in contrast to gas cylinder assemblies employed in existing applications to assist a human operator in raising, lowering, opening, closing, folding, or unfolding a movable linkage, which are typically adapted to exert both spring forces and stabilizing forces that increase with increasing velocity of a piston relative to a cylinder to resist rapid extension of the cylinder assemblies. Such stabilizing forces are desired in some applications, such as in opening the door of a car trunk, which might otherwise swing open dangerously quickly. However, the present inventors have found that a high-speed cylinder assembly, defined as a gas cylinder assembly adapted to exert a spring force and substantially no stabilizing force to resist rapid extension, is preferred for use in folding choral risers according to the invention, which are sufficiently heavy so that an additional internal force is not needed to prevent the spring force of a typical gas cylinder from folding the choral riser at a dangerous speed. The lack of resistance to rapid extension in the high-speed cylinder assemblies used makes choral risers according to the present invention even easier to fold. High-speed cylinder assemblies are also described and illustrated in U.S. patent application Ser. No. 12/455,204, which is hereby incorporated by reference.

While the invention has been described with respect to certain preferred embodiments, as will be appreciated by those skilled in the art, it is to be understood that the invention is capable of numerous changes, modifications and rearrangements, and such changes, modifications and rearrangements are intended to be covered by the following claims.

What is claimed is:

1. A mobile folding choral riser comprising a base frame;

a plurality of casters mounted to a bottom side of the base frame and configured to support the choral riser during movement and storage of the choral riser;

a folding deck linkage connected to a front side of the base frame;

a plurality of tiered decks attached to the folding deck linkage and configured to move to and from an at least substantially horizontal orientation corresponding to an unfolded use position of the folding deck linkage and a generally vertical orientation corresponding to a folded moving and storage position of the folding deck linkage; and a high-speed cylinder assembly having a first member and a second member slidably connected to the first member for movement of the members between fully contracted and fully extended positions, the first member having a first end connected to the base frame and the second member having a second end connected to the folding deck linkage;

wherein the cylinder assembly contains compressed fluid adapted to produce a force tending to move its members apart from each other to extend the assembly toward the fully extended position, wherein extending the cylinder assembly toward the fully extended position causes the decks to fold upwardly and rearwardly toward the folded position, and wherein the cylinder assembly produces substantially no damping force to oppose extension movement of the assembly.

2. The choral riser of claim 1, further comprising a back railing linkage connected to a rear side of the base frame, the back railing linkage including a back railing member, the back railing member having an attached back railing foot, and the back railing linkage being configured for movement of the back railing member relative to the base frame to and from a lowered use position, in which the back railing foot contacts a floor surface when the choral riser is supported on the floor surface to bear at least a portion of the weight of the back railing member and to restrain movement of the choral riser across the floor surface, and a raised moving and storage position, in which the back railing foot is lifted off of the floor surface, and the back railing member including a rear obstruction extending above a rearmost one of the plurality of decks and configured to at least substantially prevent a person standing on the rearmost deck from falling backwards off of the rearmost deck.

3. The choral riser of claim 2, further comprising a deck foot attached to the folding deck linkage and configured to contact a floor surface to bear at least a portion of the weight of and supported by the decks and to restrain movement of the choral riser across the floor surface when the choral riser is supported on the floor surface and the folding deck linkage is in the unfolded position, the deck foot configured to lift off of the floor surface when the folding deck linkage is moved from the unfolded position toward the folded position and to remain off of the floor surface when the folding deck linkage is in a partially folded position or the folded position.

4. The choral riser of claim 1, the plurality of tiered decks being constrained to move together to and from the unfolded use position and the folded moving and storage position.

* * * * *